US005269071A

United States Patent [19]

Hamabe et al.

[11] Patent Number: 5,269,071

[45] Date of Patent: Dec. 14, 1993

[54] HAIR AND BODY DRYING DEVICE

[75] Inventors: Takafumi Hamabe, Hirakata; Hideo Okutsu, Hikone; Hirotaka Chosa, Hikone; Akira Mori, Hikone, all of Japan

[73] Assignee: Matsushita Electric Works, Ltd., Osaka, Japan

[21] Appl. No.: 885,875

[22] Filed: May 20, 1992

[30] Foreign Application Priority Data

May 20, 1991 [JP] Japan ..... 3-114880
May 20, 1991 [JP] Japan ..... 3-114881

[51] Int. Cl.[5] ..... F26B 19/00

[52] U.S. Cl. ..... 34/48; 34/54; 34/55; 34/90; 34/97; 392/381

[58] Field of Search ..... 34/90, 91, 96, 97, 98, 34/201, 202, 44, 48, 53, 54, 55; 392/379, 380, 381

[56] References Cited

U.S. PATENT DOCUMENTS 3,449,838 6/1969 Chancellor, Jr. ..... 34/90
3,878,621 4/1975 Duerre ..... 34/90
4,685,222 8/1987 Houck, Jr. ..... 34/243 R
4,961,272 10/1990 Lee ..... 34/202

FOREIGN PATENT DOCUMENTS 56-74898 3/1981 Japan .
56-173113 6/1981 Japan .
2-20224 2/1990 Japan .
2-79829 6/1990 Japan .
2-252405 10/1990 Japan .
3-4735 1/1991 Japan .
3-24004 3/1991 Japan .
3-97408 4/1991 Japan .

*Primary Examiner*—Henry A. Bennet
*Assistant Examiner*—Denise L. Gromada
*Attorney, Agent, or Firm*—Stevens, Davis, Miller & Mosher

[57] ABSTRACT

A hair drying device includes a blower unit incorporating a fan and a heater for generating a hot air blow and provided at its one end with an air outlet for discharging the hot air blow. The blower unit is pivotally supported to a frame which is adapted to be mounted in or on a generally vertical wall of a room for pivotally supporting the blower unit at the other end about a horizontal axis so that the blower unit is capable of moving about the horizontal axis within a predetermined angular range between a retracted position of directing the air outlet generally vertically downwardly and an extended position of directing the air outlet outwardly and downwardly. A start position is provided offset adjacent to the retracted position so as to define within the angular range a swing range extending from the start position to the extended position. The blower unit is driven to swing within the swing range about the horizontal axis in a reciprocating manner. A control circuit is included to actuate the fan and the heater only when the blower unit swings within thus defined swing range and disable the fan and the heater while the blower unit moves between the retracted position and the start position.

9 Claims, 12 Drawing Sheets

HAIR AND BODY DRYING DEVICE

BACKGROUND OF THE INVENTION

1. Field of the Invention

The present invention is directed to a hair drying device, and more particularly to a swinging hair and body drying device which is adapted to be mounted in or on a wall to blow hot air over a wide range for drying the hair and body of a user.

2. Description of the Prior Art

Prior art hair and body drying devices are generally classified into two types, one having a fixed blower unit with movable deflectors in an outlet for flowing a hot air over a certain angular range and the other having a movable blower unit with a fixed air outlet for selectively flowing a hot air to a desired direction within a certain angular range. In the former type, however, the movement of the deflectors are restricted within a limited space of the air outlet such that the hot air can be directed only within a limited angular range, thus failing to satisfy a demand of directing the hot air over a wide angular range to extensively cover the head and the body of the user. The blower unit of the latter type is made swingable so as orient the hot air blow to a desired direction, however, it is not designed to swing while still generating the hot air blow but rather to select the direction of the air blow. Therefore, this type of the device also fails to supply the hot air continuously over a wide angular range sufficiently to dry the hair and body of the user.

SUMMARY OF THE INVENTION

The above problems have been successfully eliminated in the present invention which provides a novel hair drying device capable of directing a hot air blow over a wide angular range. The hair drying device in accordance with the present invention comprises a blower unit incorporating a fan and a heater for generating a hot air blow and provided at its one end with an air outlet for discharging the hot air blow. The blower unit is supported on a frame which is adapted to be mounted in or on a generally vertical wall of a toilet or bathroom for pivotally supporting the blower unit at the other end about a horizontal axis. Thus, the blower unit is capable of moving about the horizontal axis within a predetermined angular range between a retracted position of directing the air outlet generally vertically downwardly and an extended position of directing the air outlet outwardly and downwardly. A start position is provided offset adjacently to the retracted position so as to define within the angular range a swing range extending from the start position to the extended position. The blower unit is driven to swing within the swing range about the horizontal axis in a reciprocating manner. A control circuit is included to actuate the fan and the heater only when the blower unit swings within thus defined swing range and disable the fan and the heater while the blower unit moves between the retracted position and the start position. With this arrangement, the blower unit can swing over a wide angular range while flowing the hot air, thus enabling to dry an extended portion of the user's body including the hair. This is also advantageous to compensate for a height variation between different users. For example, adults and children of different heights can equally enjoy the hair drying with this swinging blower unit. Also because the fan and the heater are disabled when the blower unit just comes out of or moves back into the retracted position, the hot air is prevented from accidentally and uselessly flowing vertically downwardly toward the wall or adjacent parts of the frame other than the human body, thereby avoiding damage to the wall or the associated parts of the frame by the hot air.

Accordingly, it is a primary object of the present invention to provide a hair drying device which is capable of directing the hot air blow over a wide angular range for assuring the comfortable hair drying to the users of different heights in a convenient manner, yet assuring a safe operation of avoiding any damage to the surrounding by the hot air.

The blower unit is capable of generating a hot air and a cool air blow selectively so that the user can enjoy cooling of the body, in addition to the hot air drying. In a preferred embodiment, the control circuit is configured to move the blower unit back into the retracted position as soon as the fan is deenergized. Thus, the blower unit can be retracted simply by turning off the fan without requiring an additional operation, which is therefore another object of the present invention.

A tension spring is connected between the blower and the frame to bias blower unit toward the extended position from the retracted position against the gravity acting on the blower unit. Thus, the blower unit can be driven to swing with a reduced power requirement, which is therefore a further object of the present invention.

The swing range in which the blower unit repeats swinging is set to be variable in order to select a suitable angular range depending upon the requirement of the installation site or the user's preference. Preferably, the swing range is between 20 to 70 degrees with respect to the vertical.

The device includes a time counter which monitors a time period taken for swinging the blower unit between the start position and the extended position, and generating an alarm signal when the monitored time period exceeds a predetermined standard swing time period. In response to the alarm signal, the control circuit operates to stop swinging the blower unit. The alarm signal occurs when the blower unit stalls accidentally as a result of that, for example, the swinging movement of the blower unit is interrupted by the user or other mechanical problems. Upon occurrence of the alarm signal, the control circuit acts to stop actuating the blower unit as a safeguard for protection of the blower unit and a driving mechanism thereof, which is therefore a still further object of the present invention.

The time counter also monitors a time period required for moving the blower unit back into the retracted position, and generating a like alarm signal when the monitored time period exceeds a predetermined retraction time period. The control circuit, also in response to such alarm signal, causes the blower unit to stop moving the blower unit in order to avoid damaging the blower unit and the driving mechanism thereof.

The frame is vertically elongated and formed with a vertically spaced set of a recess, a heat radiator, and a discharge port. It is the recess that is positioned at the upper end of the frame for supporting the blower unit in such a manner as to receive therein the blower unit in the retracted position and to otherwise project it outwardly therefrom. The recess has an opening which comes into registration with the air outlet of the blower unit in the retracted position. The heat radiator extends in the middle of the frame for warming the body of the user standing in front of the frame. The discharge port is positioned at the lower end of the frame and is communicated with the opening of the recess through a duct extending internally of the frame. The control circuit is configured to allow the fan and heater to generate the hot air when the blower unit is kept in the retracted position, thereby feeding the hot air through the duct and outwardly through the discharge port. The resulting hot air is directed to the feet of the user standing in front of the frame and also to the bottom of the room for warming the user's feet as well as the room effectively.

It is therefore a still further object of the present invention to provide a hair drying device which is capable of being best utilized also for warming the user's feet and the room.

These and still other objects and advantageous features of the present invention will become more apparent from the following detailed description of the embodiment when taken in conjunction with the attached drawings.

DETAILED DESCRIPTION OF THE EMBODIMENT

Figure 1:
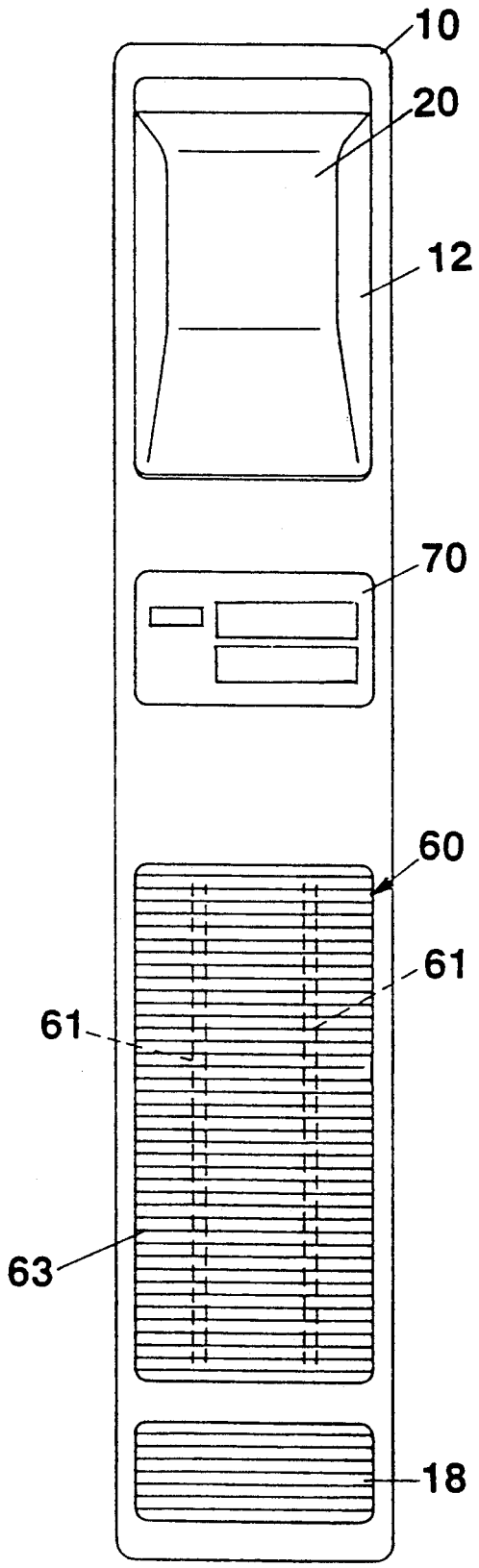
FIG. 1 is a front view of a hair drying device in accordance with a preferred embodiment of the present invention.
Figure 2:
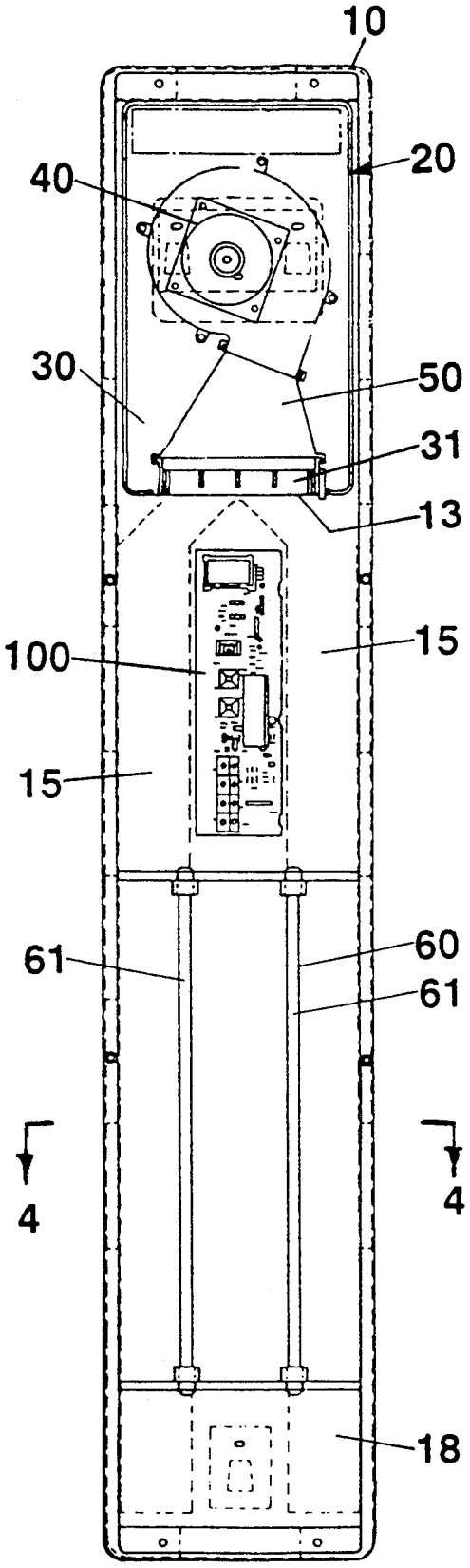
FIG. 2 is a vertical front section of the hair drying device.
Figure 3:
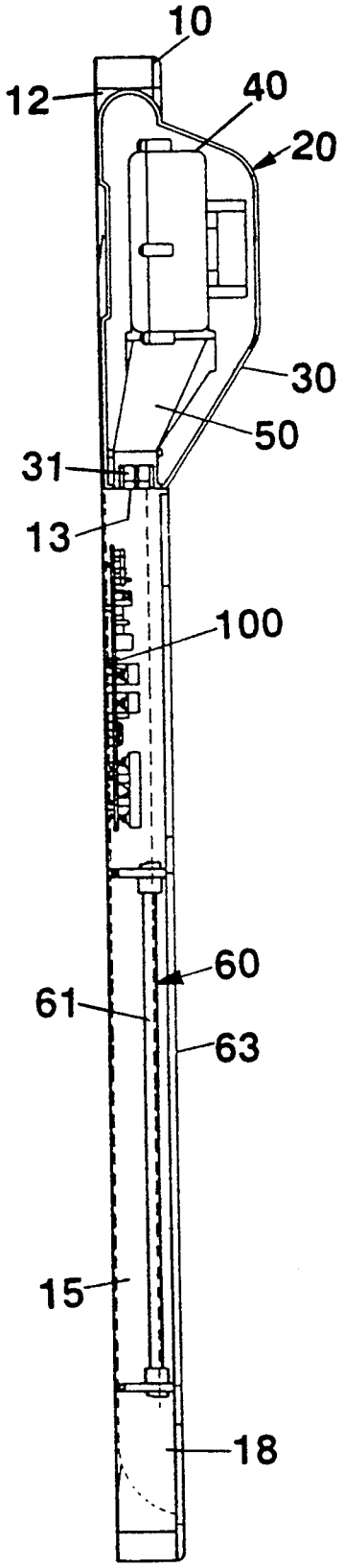
FIG. 3 is a vertical side section of the hair drying device.
Figure 4:
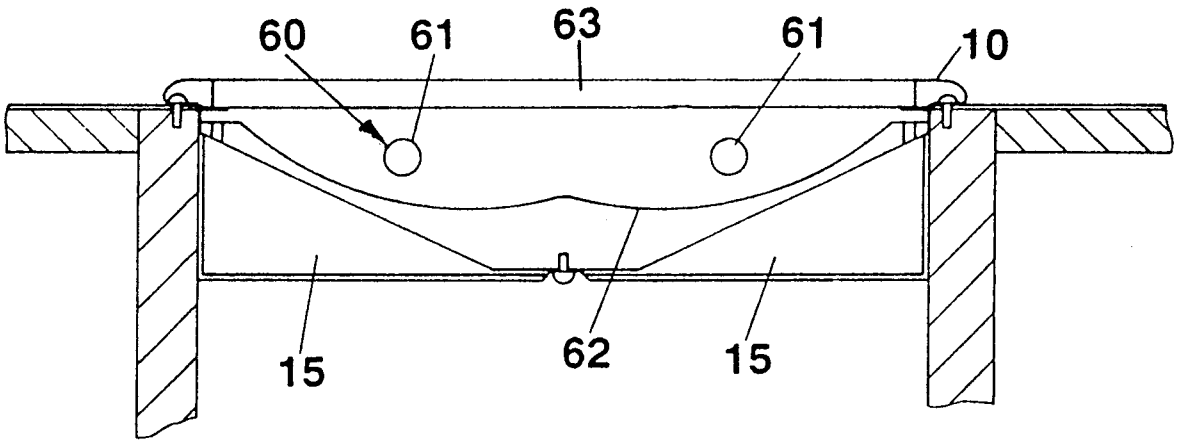
FIG. 4 is a horizontal cross section taken along line 4—4 of FIG. 2.
Figure 5:
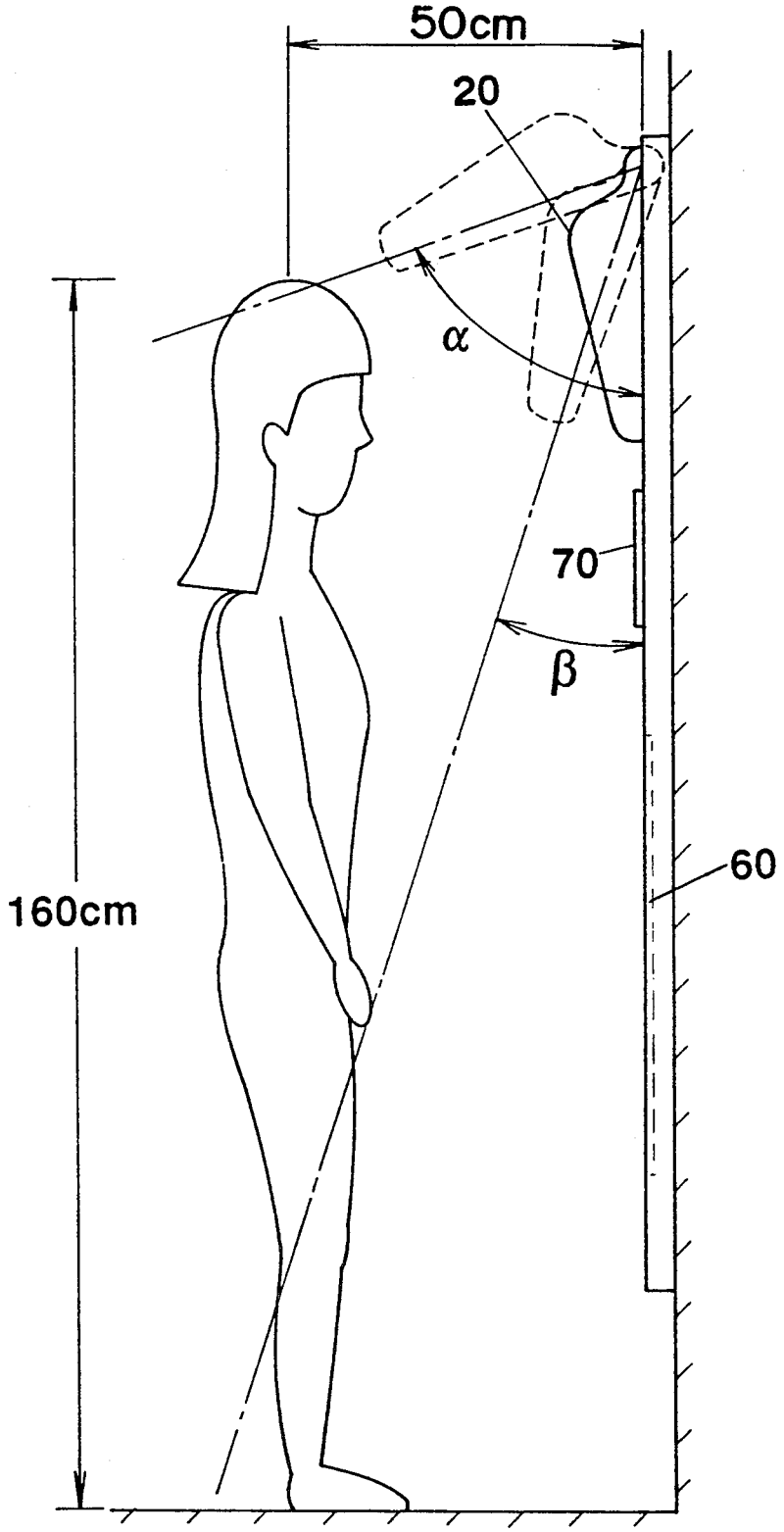
FIG. 5 is a schematic view illustrating the operation of the device.

Referring now to FIGS. 1 to 3, there is shown a hair drying device in accordance with a preferred embodiment of the present invention which is adapted to be installed in a toilet or bathroom for drying the hair and/or the body of a user. The device comprises a vertically elongated frame 10 which is mounted on or partly within a wall of the room and carries a blower unit 20 at its upper end and a heat radiator 60 extending in the lower portion above a grilled discharge port 18 at the lower end of the frame 10. The frame 10 is formed at its upper end with a generally rectangular recess 12 for receiving therein the blower unit 20 in such a manner as to permit it to project outwardly, as will be discussed in detail. Provided on the frame 10 between the blower unit 20 and the heat radiator 60 is a control panel 70 which includes a number of switches for control of the blower unit 20 and the heat radiator 60. The frame 10 is dimensioned and mounted so as to position the blower unit 20 adjacent the head of the user of the average height standing in front of the device, while the heat radiator 60 faces against the waist and the lower portion of the user's body, as shown in FIG. 5. The recess 12 is formed in its lower bottom with an opening 13 which is communicated to the discharge port 18 through a duct 15 extending internally of the frame 10 along the rear side of the heat radiator 60. The heat radiator 60 includes a pair of far-infrared radiator tubes 61 which are energized by electricity and controlled by a control circuit (not shown) in accordance with a user's selection at the control panel 70, for example, between high and low temperatures. A reflector 62 is provided on the rear of the radiator tubes 61, as best shown in FiG. 4, for reflecting the radiation through a slotted guard 63 in the front face of the frame 10.

Figure 6:
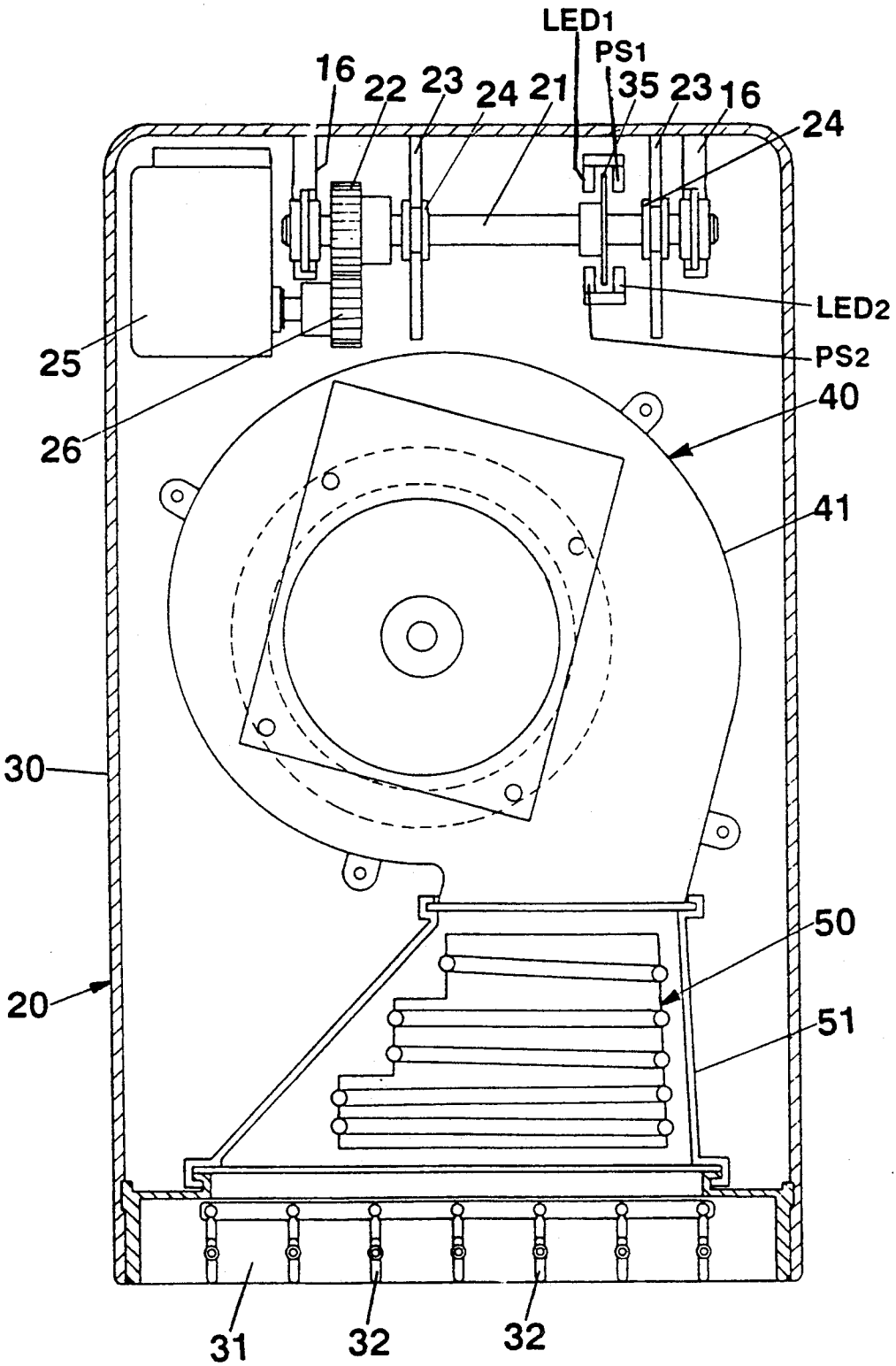
FIG. 6 is a front view partly in section of a blower unit utilized in the device.
Figure 7B:
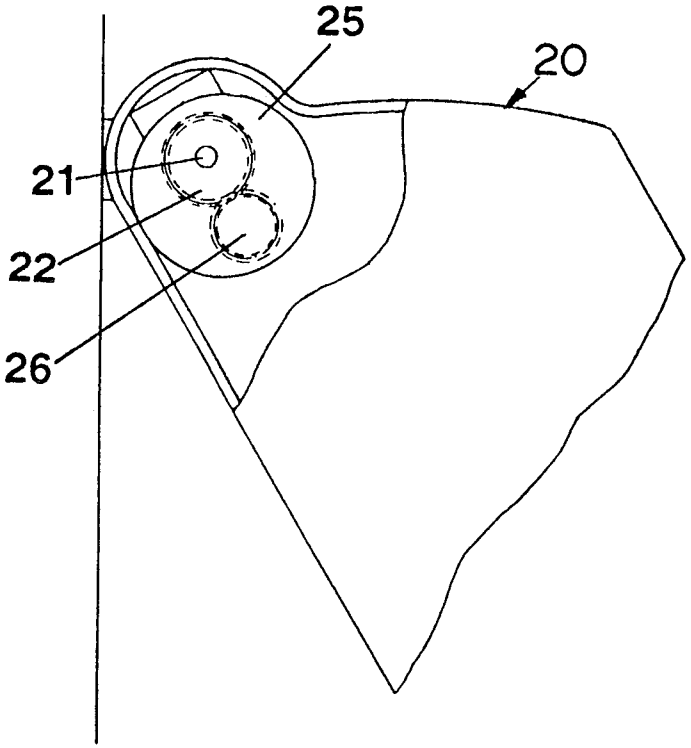
FIGS. 7A and 7B are schematic views illustrating a swinging movement of the blower unit, respectively.
Figure 7A:
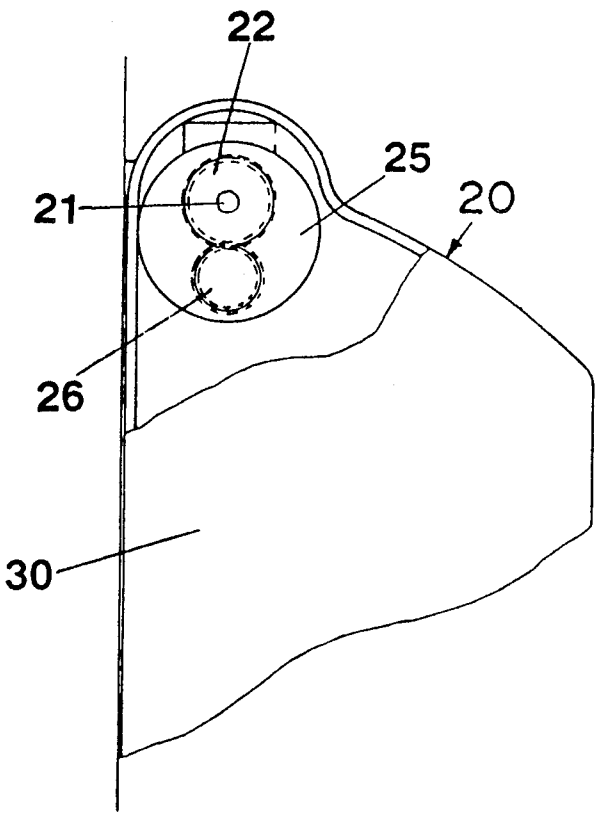

The blower unit 20 comprises a generally rectangular flattened housing 30 incorporating a blower fan 40 and a heater 50 for selectively generating a hot air blow and a cool air blow through an air outlet 31 at one longitudinal end of the housing 30. Located at the other longitudinal end of the housing 30 is a swing device for swinging the blower unit 20 about a horizontal axis between a retracted position within the recess 12 and an extended position. As shown in FIG. 6, the swing drive includes a horizontally extending shaft 21 which is fixed on the bottom of the recess 12 by means of brackets 16 at the longitudinal ends of the shaft 21, and carries a stationary gear wheel 22 adjacent the bracket 16. The shaft 21 is connected to the housing 30 of the blower unit 20 by a pair of support members 23 with bearings 24 fitted on the shaft 21 between the brackets 16 such that the blower unit 20 is supported by the shaft 21 to be rotatable thereabout. Also included in the swing drive is an electric motor 25 with a pinion 26 fixed on its output rotor shaft. The motor 25 is secured to the housing 30 with the pinion 26 kept in engagement with the stationary gear wheel 22 so that the pinion 26 rotates along the circumference of the gear wheel 22, thereby swinging the blower unit 20 about the shaft 21, as shown in FIGS. 7A and 7B. The motor 25 is a reversible motor for swinging the blower unit 20 back and forth between the retracted position and the extended position.

Figure 8:
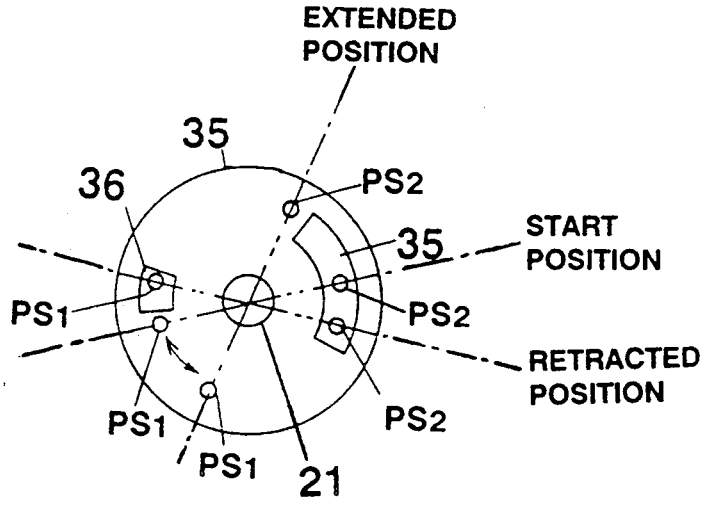
FIG. 8 is a view of a disk and position detectors provided in the blower unit for detection of the angle of the blower unit relative to a frame of the device.
Figure 9C:
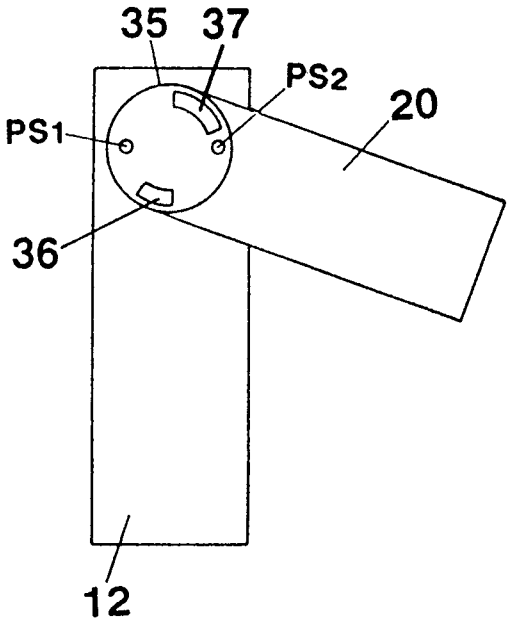
FIGS. 9A to 9C are schematic views illustrating a retracted, starting, and extended positions of the blower unit, respectively.
Figure 9B:
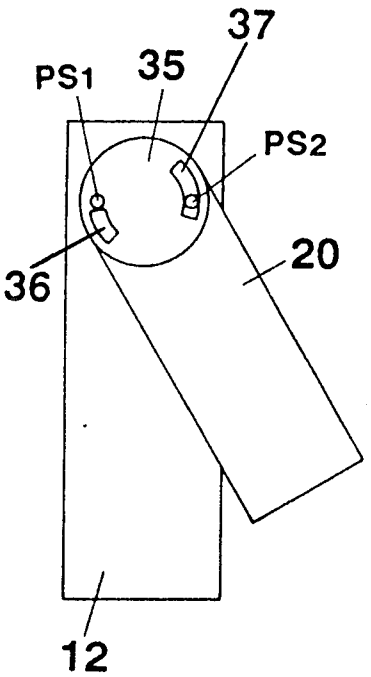
Figure 9A:
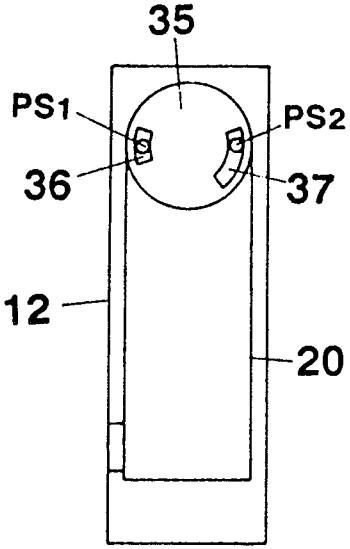

For determination of the retracted and extended positions, a position detector is provided to comprise a disk 35 fixed on the shaft 21 and a set of photo-sensors $PS_1$ and $PS_2$ fixed to the housing 30 to be relatively rotatable around the fixed disk 35 together with light emitting diodes $LED_1$ and $LED_2$ for directing individual light beams to the photo-sensors $PS_1$ and $PS_2$. As shown in FIG. 8, the disk 35 includes a narrow slit 36 and a wide slit 37 extending circumferentially about the shaft 21 for passing and interrupting the light beams to the individual photo-sensors $PS_1$ and $PS_2$ as the blower unit 20 swings about the shaft 21. These slits 36 and 37 are circumferentially spaced, as shown in FIGS. 8 and 9, such that both of the photo-sensors $PS_1$ and $PS_2$ receive the light beams through the slits 36 and 37, respectively when the blower unit 20 is in the retracted position of FIG. 9A, that the sensor $PS_1$ no longer receives the light beam while the other sensor $PS_2$ is receiving the light beam when the blower unit 20 swing to a start position of FIG. 9B which is offset toward the extended position from the retracted position, and that the sensor $PS_2$ becomes missing the corresponding light beam when the blower unit 20 swings to the extended position of FIG. 9C. With this result, the device can acknowledge the positions of the blower unit 20 and controls it so as to repeat swinging the blower unit 20 between the start position and the extended position and to allow the blower fan 40 and heater 50 to be energized only when the blower unit 20 is between the start and extended positions or in a swing range defined therebetween, whereby preventing a danger of directing the hot air to the frame 10 adjacent the blower unit 20 which would otherwise damage the frame 10. It is noted in this connection that the blower unit 20 is allowed to move between the retracted position as indicated by solid lines in FIG. 5 and the extended position as indicated by dotted lines over a wide angular range of $\alpha$, while the fan 40 and the heater 50 are disabled during the movement between the retracted position to the start position over a limited angular range of $\beta$, and to swing repeatedly over a relative wide angular range of $\alpha$-$\beta$ or the swing range between the start position and the extended position while discharging the hot or cool air blowing through the air outlet 31 sufficient to cover the head and the upper portion of the user's body. One or more additional slits may be formed in the disk 35 together with corresponding sets of like sensors and LEDs for defining one or more positions of the blower unit 20 between the start and extended positions such that the user can select a suitable range within which the blower unit 20 is allowed to swing repeatedly while blowing the hot air or cool air. In other words, the swing range of the blower unit 20 can be made variable by the selection of the user at the control panel 70. Further, it is noted in this connection that the above motor 25 includes a clutch (not shown) capable of disengaging the pinion 26 from an output rotor (not shown) such that the pinion 26 can be forced to rotate manually, enabling the to change its angular orientation manually by the user blower unit 20 to change its angular orientation manually by the user.

Figure 11:
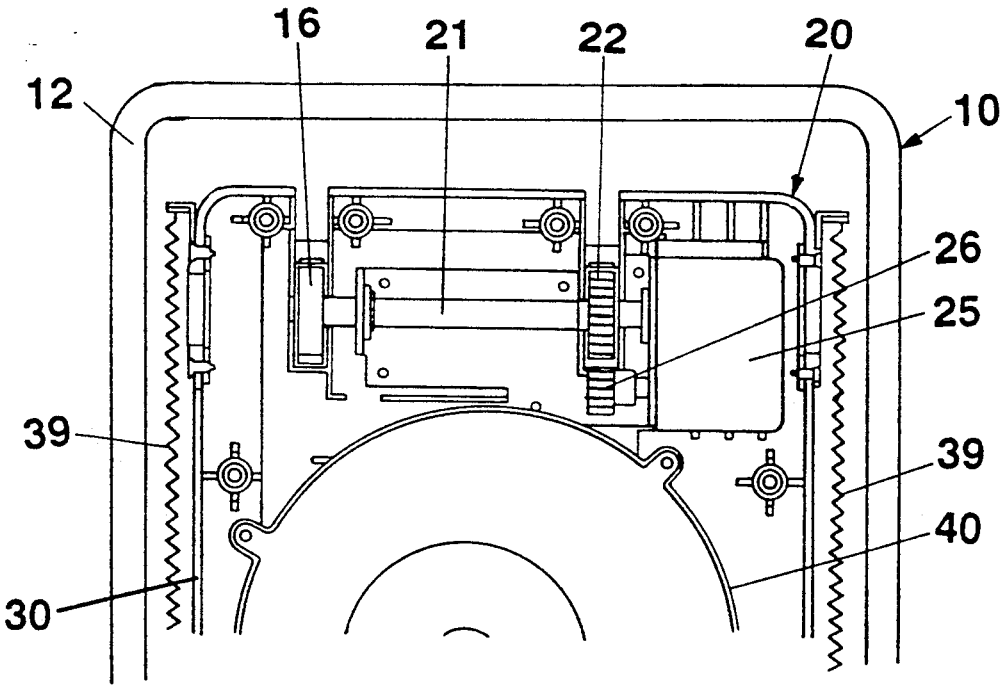
FIG. 11 is a rear view of a portion of the blower unit.
Figure 12:
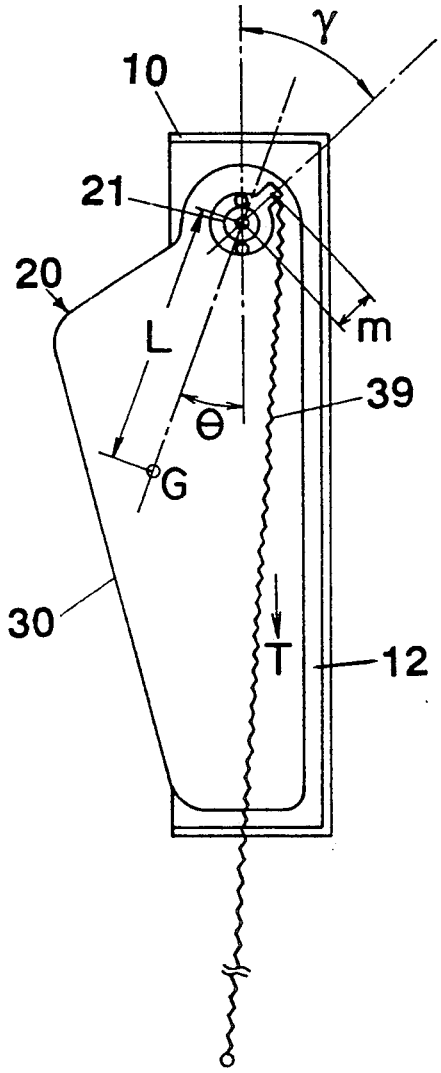
FIG. 12 is a schematic view illustrating an operation of a spring biasing the blower unit toward the extended position.
Figure 13:
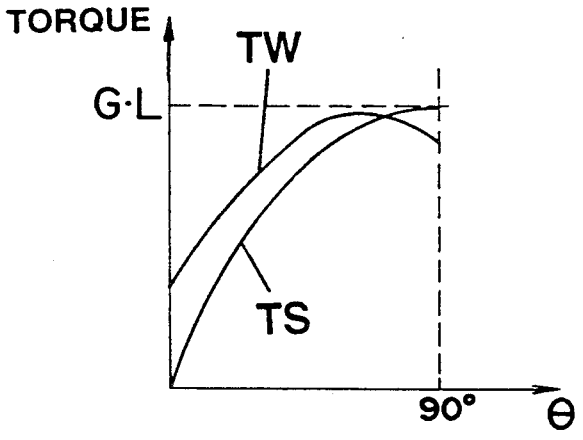
FIG. 13 is a graph illustrating a relation between a torque acting on the blower unit about a horizontal axis by gravity and a torque acting thereon by the spring.

Turning back to FIG. 6, the blower fan 40 is a centrifugal fan driven by an electric motor (not shown) and is mounted centrally of the housing 30 to direct the forced air flow through a volute casing 41 and through a flared channel 51 provided with the heater 50 in the form of a coiled element. The flared channel 51 terminates in the air outlet 31 with a plurality of deflectors 32 to direct the hot or cooled air to blow outwardly. The deflectors 32 are accessible by the user to deflect the air blow in the direction along the length of the air outlet 31 or in the direction perpendicular to the swinging movement of the blower unit 21. As shown in FIG. 11, a pair of tension coil springs 39 extends laterally along the sides of the housing 30 of the blower unit 20 from one longitudinal end of the housing 30 adjacent the shaft 21 to the frame 10 in order to bias the blower unit 20 toward at least to the start position from the retracted position. To this end, each spring 39 is connected to the blower unit at a portion spaced from the axis of the shaft 21 by a slight distance m oppositely of a centre of gravity G of the blower unit 20 from the axis of the shaft 21, and angularly spaced from the vertical by an angle of $\gamma$ when the blower unit 20 is in the retracted position, as shown in FIG. 12. With this arrangement, the weight of the blower unit 20 acts to give a torque $Tw=G\cdot L\cdot\sin\theta$, while the springs 28 give a spring torque $Ts=T_0+R\cdot m\cdot\cos(\theta+\gamma)$ in which $T_0$ is an initial tension force by the springs 39 and T is a spring constant. Therefore, in order to swing the blower unit 20 the motor 25 it is only required to have a reduced torque which is equal to $|Tw-Ts|$ over the wide angular range, as shown in FIG. 13.

Figure 10:
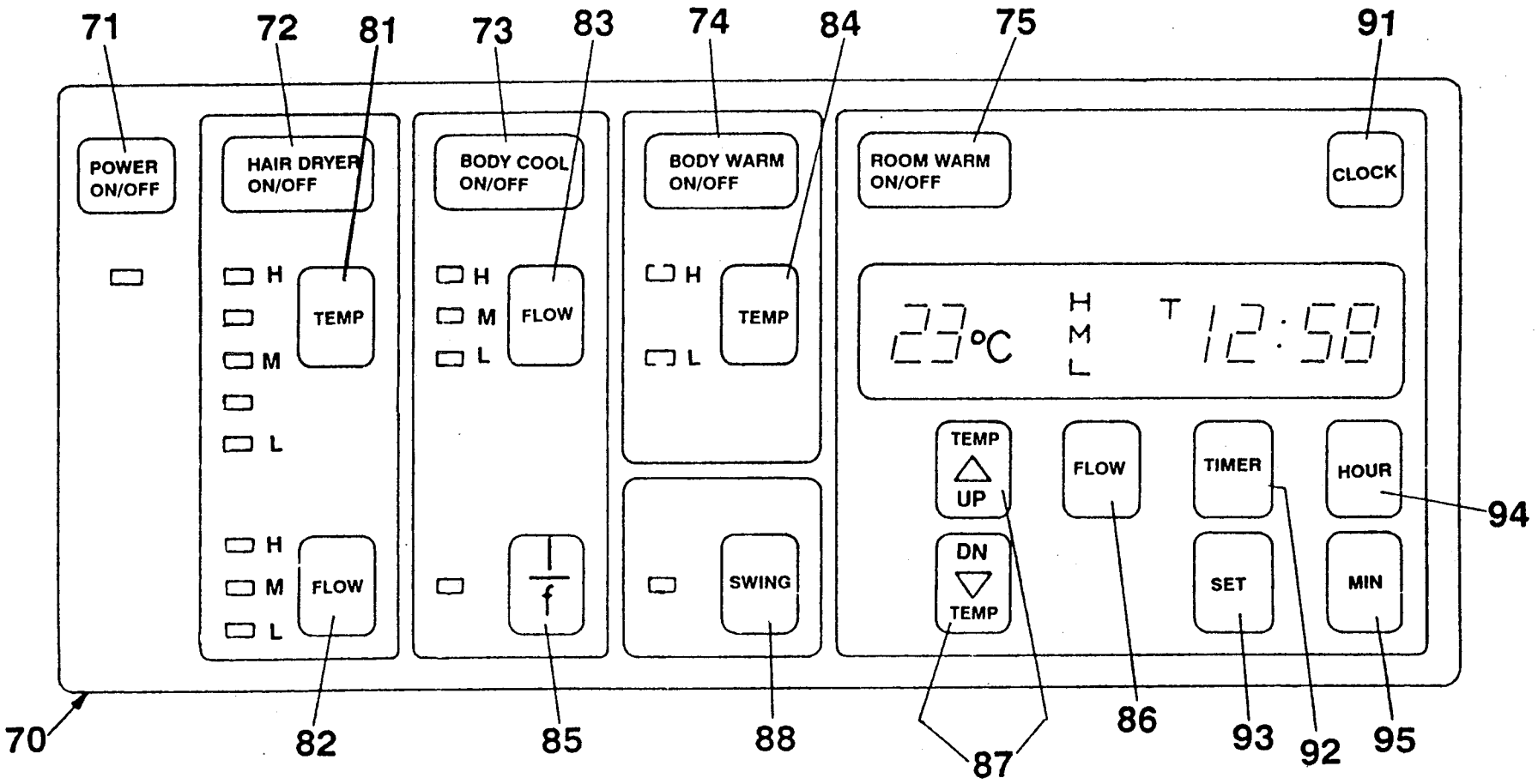
FIG. 10 is a front view of a control panel of the device.

Operation of the device will be discussed with reference to FIG. 10 which illustrates a plurality of switches and indicators on the control panel 70. The control panel 70 includes, in addition to a power switch 71, a hair dry switch 72, body cool switch 73, body warm switch 74, and a room warm switch 75 for selecting one or two of the four operations at a time. When the hair dry switch 72 is turned on, a control is made firstly to move the blower unit 20 out of the retracted position to the start position and then to repeat swinging the blower unit 20 within the swing range while generating the hot air blow of which temperature and flow rate are selected from predetermined values of "Low", "Medium", and "High" settings at a temperature selector 81 and at a flow rate selector 82, respectively. Thus, the user can enjoy drying over an extended portion of the hair, or long hair. The selected settings are confirmed by corresponding sets of indicators arranged adjacent the switches 81 and 82. When the body cool switch 72 is turned on, the blower unit 20 is likewise driven to the start position followed by being driven to swing within the swing range while generating the cool air from the air outlet of the blower unit 20 with the heater 50 kept deenergized so that the user can enjoy cooling of the head and the upper half portion by the cool air blow. In this operation mode, the flow rate is also selected from predetermined values of "Low", "Medium", and "High" settings at a flow rate selector 83, respectively. An auto flow selector 85 is turned on instead, a natural and comfortable flow of the cool air is given to continuously vary the flow rate. When the body warm switch 74 is turned on, the heat radiator 60 is energized to radiating the heat to the user. The temperature is set between "High" and "Low" by a corresponding selector 84. When the room warm switch 75 is turned on, the blower unit 20 is locked into the retracted position to make the air outlet 31 in registration with the opening 13, thereby directing the hot air blow through the duct 15 and discharging it out of the discharge port 18 at the lower end of the device for warming the bottom of the room and the feet of the user when standing in front of the device. The temperature and flow rate of the hot air from the discharge port 18 are also selected by corresponding selectors 86 and 87. When the room warm switch 75 is turned on or the power switch 75 is turned off while the blower unit 20 is not in the retracted position, the blower unit 20 is brought back into the retracted position. Additionally, the control panel 70 includes a LCD (liquid crystal display) for indication of the selected temperature and the flow rate together with a clock time. A timer operation is also included to set a turn-on and/or turn-off time and also an on-time duration of the device which are set by corresponding switches 91 to 95. It should be noted at this time that when the device is either in the hair dry mode or body cool mode, the blower unit 20 can be locked in a suitable angular position by turning off a swing selector 88. Otherwise, the blower unit 20 repeats swinging about the horizontal axis to direct the hot or cool air blow over a wide angular range. Although not shown in FIG.

10, the control panel 70 may additionally includes a selector for varying the swing range within which the blower unit 20 is allowed to swing while directing the hot or cool air blow therefrom.

The above controls are effected by the control circuit including a micro-computer and associated electronic components assembled into a circuit module 100 mounted on the rear of the control panel 70. The control circuit can be realized in the state of the art and therefore no detail circuit diagram thereof is deemed unnecessary. However, it should be noted that the control circuit is designed to achieve safeguards for protection of the motor 25 when the swinging movement of the blower unit 20 is interrupted unintentionally. In one case when the blower unit 20 is accidentally locked over a certain time period during its swinging movement, the control circuit responds to stop driving the motor 25. For this purpose, the control circuit includes a time counter which counts the time taken to swing the blower unit 20 from the start position to the extended position or vice versa. The control circuit is responsible for comparing the thus counted time with a predetermined standard swing time so as to judge that the blower unit is locked when the counted time exceeds the standard swing time, thereby stopping the motor 25. The standard swing time is related to the swing range and is therefore automatically set to a suitable value as the swing range is varied. In the other case when the blower unit 20 is locked during the movement between the retracted position and the start position, the control circuit responds to stop driving the motor 25. Also in this condition, the control circuit lets the time counter count a time required for such movement and compares the thus counted time with a predetermined standard retraction time, whereby the control circuit judges that the blower unit 20 is locked between the retracted and extended positions when the counted time exceeds the standard retraction time and instructs to stop driving the motor 25.

The heat radiator 60 may be controlled by a sensor capable of detecting the presence of the user in front of the device for energizing the heat radiator 60 only when the body warm switch 74 is turned on and the user's presence is detected by the sensor. Preferably, such sensor may be a doppler sensor capable of acknowledging the approach of the user, which sensor cooperates with a suitable timer so as to turn on the heat radiator for a limited time interval from the time of the user's coming in front of the device.

What is claimed is:

1. A hair drying device comprising:

a blower unit incorporating fan means and heating means for generating a hot air blow, said blower unit having a rear end and a front end with an air outlet through which said hot air blow is discharged;

a supporting structure for mounting on a generally vertical wall of a room for pivotally supporting said blower unit at the rear end thereof about a horizontal axis so that said blower unit is capable of moving about said horizontal axis within a predetermined angular range between a retracted position of directing said air outlet generally vertically downwardly and an extended position of directing said air outlet outwardly and downwardly past a start position offset adjacent to said retracted position, said start position and extended position defining therebetween a swing range;

driving means connected to move said blower unit between said retracted position and said extended position and to swing said blower unit in a reciprocating manner between said start position and the extended position, said driving means comprising an electric motor; and control means actuating said fan means and heating means only when said blower unit swings within said swing range and disabling said fan means and heating means while said blower unit moves between said retracted position and the start position.

2. A hair drying device as set forth in claim 1, wherein said blower unit includes means for generating a hot air and a cool air blow selectively.

3. A hair drying device as set forth in claim 1, wherein said control means operates to move said blower unit back to the retracted position in response to said fan means being switched to be deenergized.

4. A hair drying device as set forth in claim 1, including tension spring means extended between said blower unit and said supporting structure to bias said blower unit toward said extended position from said retracted position.

5. A hair drying device as set forth in claim 1, wherein said swing range is defined to extend angularly from about 20 to 70 degrees with respect to the vertical.

6. A hair drying device as set forth in claim 1, wherein said swing range is made variable.

7. A hair drying device as set forth in claim 1, including time counting means monitoring a time period taken for swinging said blower unit between said start position and said extended position and generating an alarm signal when said monitored time period exceeds a predetermined standard swing time period, and said control means operating to stop swinging said blower unit in response to said alarm signal.

8. A hair drying device as set forth in claim 1, including time counting means monitoring a time period required for moving said blower unit back into said retracted position and generating an alarm signal when the monitored time period exceeds a predetermined retraction time period, said control means operating to stop moving the said blower unit in response to said alarm signal.

9. A hair drying device as set forth in claim 1, wherein said supporting structure is in the form of a vertically elongated frame which is provided with a vertically spaced set of a recess, a heat radiator, and a discharge port, said recess formed at the upper end of said frame for supporting said blower unit in such a manner as to receive therein said blower unit in said retracted position and to otherwise project it outwardly therefrom, said recess having an opening which comes into registration with the air outlet of said blower unit in said retracted position, said heat radiator formed at the middle of said frame for radiating heat outwardly, said discharge port formed at the lower end of said frame and communicated with said opening through a duct extending internally of said frame, and said control means allowing said fan and heater means to generate the hot air when said blower unit is kept in said retracted position, thereby feeding the hot air through said duct and outwardly through said discharge port.

* * * * *